United States Patent [19]

Unsted

[11] 4,257,177

[45] Mar. 24, 1981

[54] SAFETY FOOTWEAR

[75] Inventor: Lionel P. Unsted, Kettering, England

[73] Assignee: Management Operations Limited, Northamptonshire, England

[21] Appl. No.: 971,723

[22] Filed: Dec. 21, 1978

[51] Int. Cl.[3] ..... A43C 13/14

[52] U.S. Cl. ..... 36/77 R; 36/72 R; 12/146 D

[58] Field of Search ..... 36/77 R, 77 M, 72 R; 12/146 D, 12 R

[56] References Cited

U.S. PATENT DOCUMENTS

| | | | |
|---|---|---|---|
| 1,970,157 | 8/1934 | Williams | 36/77 R |
| 2,537,901 | 1/1951 | Longnecker | 36/77 R |
| 3,444,572 | 5/1969 | Broughton | 36/77 R |
| 3,798,803 | 3/1974 | Funck | 36/72 R |
| 3,805,419 | 4/1974 | White | 36/77 R |

FOREIGN PATENT DOCUMENTS

| | | | |
|---|---|---|---|
| 561187 | 7/1923 | France | 36/77 R |
| 12389 | 11/1903 | Norway | 36/77 R |
| 8950 | of 1896 | United Kingdom | 36/77 R |
| 168268 | 9/1921 | United Kingdom | 36/77 R |
| 1275384 | 5/1972 | United Kingdom . | |

*Primary Examiner*—James Kee Chi

*Attorney, Agent, or Firm*—Woodcock, Washburn, Kurtz, Mackiewicz & Norris

[57] ABSTRACT

In safety footwear, an impact-resistant toe-cap, for example of steel, has a synthetic plastics coating by means of which it is secured to the shoe. The coating, which can incorporate a base board, has a lip which is stitched to the upper. The coating may form a peripheral flange for incorporation in a stitched welt. The coating protects the wearer against head edges of the toe-cap and protects a steel toe-cap against corrosion.

8 Claims, 5 Drawing Figures

SAFETY FOOTWEAR

Figure 1:
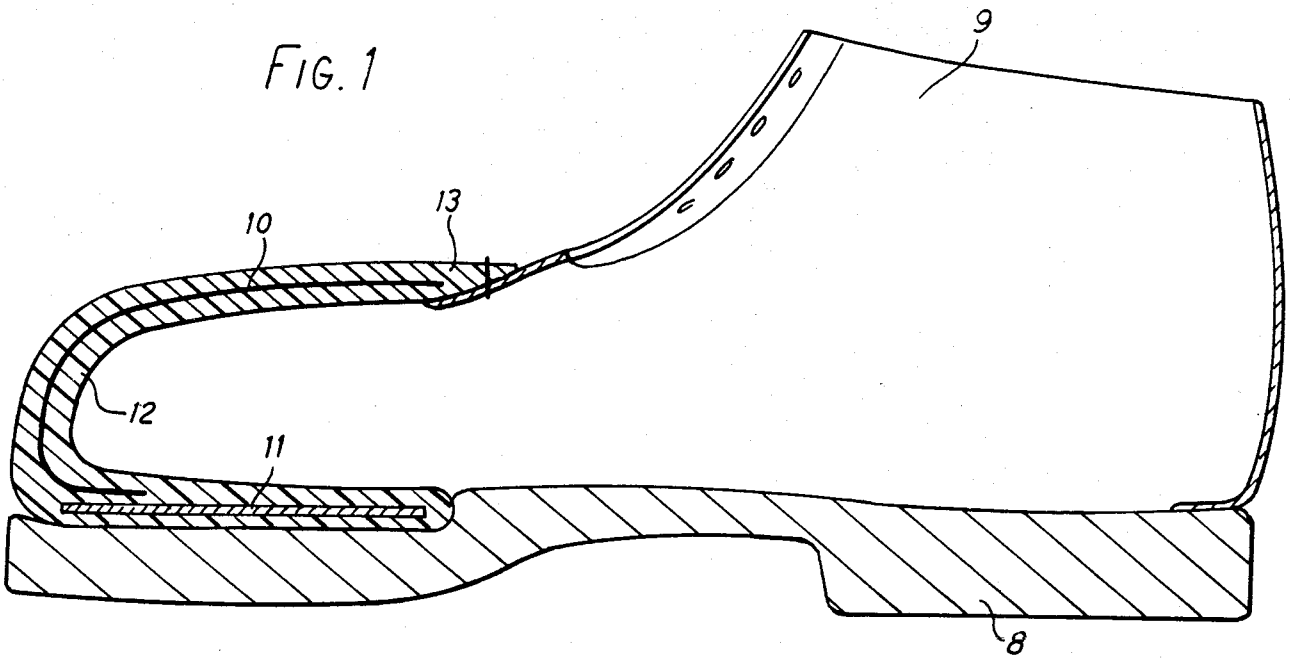

The present invention relates to safety footwear in which for the protection of the wearer's foot a metal or other impact-resistant toe-cap and, in some cases, other reinforcements are incorporated.

In existing safety footwear, whatever the method of construction used for joining the upper to the sole unit, it has always been necessary to have a lining to protect the foot against the metallic toe-cap and to fix the toe-cap safely in position. If the toe-cap is made of some other material, for example a synthetic resin with carbon-fibre reinforcement, the protective lining may not be required but the problem of fixing the toe-cap in position remains.

In accordance with the present invention there is provided safety footwear incorporating an impact-resistant toe-cap wherein the toe-cap is provided with a covering layer and is secured in the shoe by way of the covering layer. Not only does this construction facilitate assembly of the footwear, it also enables a strong structure to be obtained while not detracting from the comfort of the footwear. Thus in the preferred construction the covering layer protects the foot against contact with the toe-cap and protects the toe-cap against the chemical effects of contact with or proximity to the foot.

The covering layer may be applied in the form of a sheet of leather or other natural or synthetic material of an organic polymeric nature which is bonded to the toe-cap by a suitable adhesive. Preferably however the covering layer is in the form of a coating of synthetic plastics material which may be applied, for example, by dipping, spraying or moulding.

At the rear edge of the toe cap, in order to cushion and conceal the sharp edge of the metal, it is possible to attach a beading of synthetic plastics material after application of the covering layer. Alternatively, where the covering layer is a coating of synthetic plastics material this can be extended to form a flexible lip to the rear of the metallic edge. This lip can be tapered towards the rear. An edge strip may be affixed to the metal toe-cap before it is coated in order to form a core for this flexible lip. The edge strip may be tapered in section and may either be applied to the outer margin of the metal toe-cap or else split along its front edge to fit over the rear edge of the toe-cap.

It will be appreciated that by the use of one or other of these features at the rear edge of the toe-cap it is possible to improve the external appearance of the shoe by eliminating any hard line at the edge of the toe-cap. Internally comfort is improved by preventing any hard edge coming into contact with the foot.

The toe-cap with its covering layer can conveniently be secured within the shoe by the use of adhesives appropriate to the material of the covering layer. Where a flexible lip is formed at the rear edge of the toe-cap this can be stitched to the upper if desired.

A normal steel toe-cap has a tendency to shear through the bottom reinforcing plate and the bottom or sole unit when a severe weight is applied to the toe-cap. It will be appreciated that the presence of a covering layer bonded to the toe-cap reduces this risk by blunting the lower edge of the toe-cap and interposing an additional layer of shock-absorbing material.

It will readily be appreciated that the invention is applicable to all types of safety footwear whatever materials and methods of assembly may be used in their construction. In particular it applies equally to both externally fitted and internally fitted steel toe-caps.

Moreover it is possible to use a plastic-coated metal toe-cap not only without a lining but also without any outer in the toe region, the upper being then stitched to the rear edge of the coated toe-cap.

Figure 2:
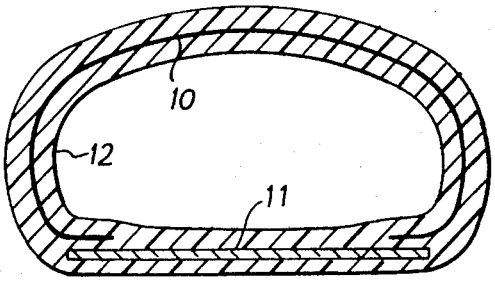
Figure 3:
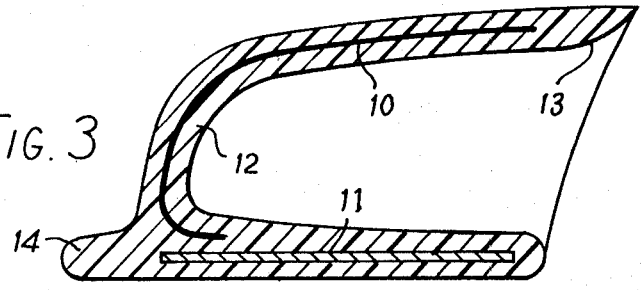
Figure 4:
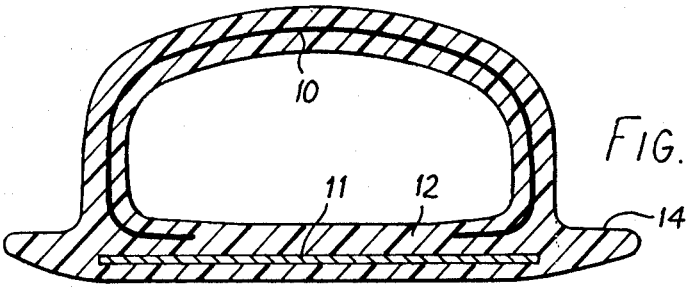
Figure 5:
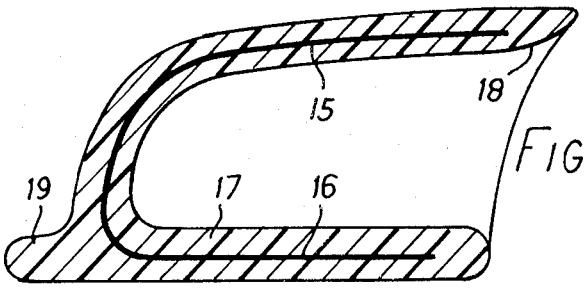

The invention will be described in more detail with the aid of examples illustrated in the accompanying drawings, in which:

FIG. 1 is a longitudinal section of a safety boot or shoe in accordance with the invention, FIG. 2 is a transverse section of the toe-cap unit used in the foot-wear of FIG. 1, FIGS. 3 and 4 are longitudinal and transverse section of a modified toe-cap unit, and FIG. 5 is a longitudinal section of a further form of toe-cap unit for footwear in accordance with the invention.

The shoe shown in FIG. 1 has a moulded sole unit 8 and an upper 9. A steel toe-cap 10 and a bonded fibre base-board 11 of conventional type are both coated with synthetic plastics material 12 to form an integral unit. At the rear edge of the toe-cap there is a tapered lip 13 which masks the sharp edge of the toe-cap to improve comfort and appearance. The upper 9 of the boot or shoe extends only to the rear edge of the toe-cap 10, where it is secured to the lip 13 by stitching, welding, stapling, or cementing or a combination of these methods. The coating 12, which is formed by moulding, serves as both the external and the internal surface of the toe-cap so that not only is the upper cut short at the junction with the toe-cap but also no separate lining of the toe-cap is required.

The structure shown in FIGS. 1 and 2 is suitable for footwear of cemented, injection-moulded, or vulcanized construction. FIGS. 3 and 4 show a modification in which the coating 12 forms an integral projecting flange 14 around the base board 11. The flange 14 can be incorporated in the welt of the shoe and stitched in position. Whereas FIGS. 1 to 4 show constructions in which the base-board is incorporated as a single unit with the toe-cap, it is also possible to have a conventional separate base-board and this separate base-board can itself be plastic-coated to give it greater resistance to physical and chemical damage.

In FIG. 5 a solid drawn metal toe-cap 15 which has a base part 16 integral with the rest of the toe-cap is incorporated in a synthetic plastics body 17 which has a rear lip 18 and a peripheral flange 19. Such a construction can again be used with or without an upper which covers the toe-cap.

As has been mentioned previously, other reinforcing components of the footwear can with advantage be provided with a covering layer or coating. For example the metal shank inserted in the instep can be coated and preferably it is embedded in a plastic part which is shaped to match the shape of the sole so that it is located in the correct position during assembly and thereby ensures correct location of the shank.

As has been mentioned a variety of methods may be employed to form the covering layer and embed or encapsulate the metal toe-cap. These include spray coating. The covering material may be a natural or synthetic organic polymeric material and examples include rubber, reconstituted leather fibre, and synthetic resins, including those reinforced with glass fibre and other fillers.

Toe-cap units in which the coating forms a peripheral flange, such as those shown in FIGS. 3 to 5, are suitable for incorporation in a veldtschoen construction in which the upper is turned outwards and stitched to form a welt.

I claim:

1. Safety footwear having an upper, a sole and an impact-resistant toe-portion, the said toe-portion comprising a rigid toe-cap, a toe-cap lining, an outer toe-cap cover and a flexible lip extending beyond the rear edge of the rigid toe-cap; the toe-cap lining, the outer cover and the flexible lip being formed of synthetic plastics material as a single unit to completely enclose the rigid toe-cap in a coating of the said plastics material bonded to the toe-cap; the toe-portion being attached by means of the flexible lip to the upper and the toe-portion being secured to the front of the sole.

2. Safety footwear as claimed in claim 1 in which the upper has an edge attached to the lip and does not cover the body of the toe-cap.

3. Safety footwear as claimed in claim 2 in which the lip is stitched to the upper.

4. Safety footwear as claimed in claim 2, 3 or 1 in which the toe-cap includes an integral base part.

5. Safety footwear as claimed in claim 4 in which the coating is in the form of a moulded unit with a peripheral flange which is fastened in the welt of the footwear.

6. Safety footwear as claimed in claim 1 further comprising a base-board, said base-board being enclosed by the coating to form an integral unit with the toe-cap.

7. Safety footwear as claimed in claim 3, 6 or 1 in which said coating is formed as a moulded unit and has a peripheral flange, said flange being fastened in the welt of the footwear.

8. Safety footwear as claimed in claim 1 in which the toe-cap is of metal.

* * * * *